US007603069B2

(12) United States Patent
Yamana et al.

(10) Patent No.: US 7,603,069 B2
(45) Date of Patent: Oct. 13, 2009

(54) FIXING APPARATUS AND IMAGE FORMING APPARATUS PROVIDED THEREWITH

(75) Inventors: Shinji Yamana, Yamatokoriyama (JP); Kenji Asakura, Kyoto (JP); Toshiaki Kagawa, Nara (JP); Hiroyuki Yamaji, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 240 days.

(21) Appl. No.: 11/685,244

(22) Filed: Mar. 13, 2007

(65) Prior Publication Data

US 2007/0217838 A1 Sep. 20, 2007

(30) Foreign Application Priority Data

Mar. 15, 2006 (JP) ..... 2006-070913

(51) Int. Cl.
*G03G 15/20* (2006.01)

(52) U.S. Cl. ..... 399/328; 399/329

(58) Field of Classification Search ..... 399/320, 399/328, 329, 330, 331; 219/216, 619
See application file for complete search history.

(56) References Cited

U.S. PATENT DOCUMENTS 7,010,255 B2 * 3/2006 Yura et al. ..... 399/328
7,107,001 B2 * 9/2006 Kameda ..... 399/328
7,187,894 B2 * 3/2007 Fuma ..... 399/320
7,194,233 B2 * 3/2007 Wu et al. ..... 399/328
2005/0117942 A1 6/2005 Ishii et al.

FOREIGN PATENT DOCUMENTS

| | | |
|---|---|---|
| JP | 2004-198659 | 7/2004 |
| JP | 2005-164691 | 6/2005 |
| JP | 2005-189427 | 7/2005 |

* cited by examiner

*Primary Examiner*—Hoan H Tran
(74) *Attorney, Agent, or Firm*—Renner, Otto, Boisselle & Sklar, LLP

(57) ABSTRACT

In a fixing apparatus and an image forming apparatus of the present invention, an external heating section is provided that includes: an external heating belt; two heat rollers suspending the external heating belt and pressed against a fixing roller via the external heating belt; and a release/contact mechanism for causing the two heat rollers to separate from or contact with the fixing roller. With the heat rollers separated from the fixing roller by the release/contact mechanism, the external heating belt and the fixing roller are in contact with each other and the external heating belt follows rotation of the fixing roller. As a result, a fixing apparatus is provided that includes an external release/contact mechanism that can quickly operate in a small space and at low power without encouraging deterioration of the belt member. An image forming apparatus provided with such a fixing apparatus is also provided.

7 Claims, 11 Drawing Sheets

FIXING APPARATUS AND IMAGE FORMING APPARATUS PROVIDED THEREWITH

This Nonprovisional application claims priority under 35 U.S.C. § 119(a) on Patent Application No. 070913/2006 filed in Japan on Mar. 15, 2006, the entire contents of which are hereby incorporated by reference.

FIELD OF THE INVENTION

The present invention relates to a fixing apparatus for fixing a toner image onto a printing medium, and an image forming apparatus provided therewith.

BACKGROUND OF THE INVENTION

Image forming apparatuses of the electrophotographic system, such as copying machines, printers, and multi-functional apparatuses (multi-functional printers) generally use a fixing apparatus employing a heat roller fixing method. The fixing apparatus includes a fixing roller and a pressure roller, which are pressed against each other. Both of or one of the fixing roller and the pressure roller are heated to a predetermined surface temperature (fixing temperature) with a heat source (for example, halogen lamp) provided inside. Printing paper with an unfixed toner image is passed through a point of contact between the fixing roller and the pressure roller (fixing nip portion), and the toner image is fixed with heat and pressure.

As the fixing roller provided in the fixing apparatus for color printers, an elastic roller with an elastic layer such as silicone rubber is commonly used. In this case, the surface of the fixing roller undergoes elastic deformation according to irregularities on the surface of the toner image, so that the surface with the toner image is covered with the fixing roller in contact with the printing paper. This is particularly suited for the fixing of unfixed toner images in color printing, which uses a larger amount of toner than monochromatic printing. Further, by the strain relieving effect of the elastic layer at the fixing nip portion, the ease of releasing toner can be improved in color printing, which readily causes offset as compared with monochromatic printing. Further, there is created a "reversed" fixing nip portion between the fixing roller and the pressure roller (the fixing roller being slightly deformed inward at the point of contact with the pressure roller). This enables the sheet to be striped more easily (self stripping), even without a stripping mechanism (stripping means) such as a stripping claw, thereby eliminating image defects caused by such stripping mechanism.

However, due to poor heat conductivity of the elastic layer, the efficiency of heat transfer suffers greatly when the heat source is provided inside the fixing roller having the elastic layer. As a result, a long warm up time is required, and, when the transport speed of sheets is increased, the surface temperature of the fixing roller cannot keep up with it.

As a countermeasure, there has been proposed a method in which the fixing roller is heated externally (from the surface) by bringing an external heating section into contact with the surface of the fixing roller (external heating and fixing method). One such method is a roller method, in which a heat roller having a heat source therein is brought into contact with the fixing roller. Another is a belt method, in which an endless belt member is heated and brought into contact with the fixing roller.

For example, Patent Publications 1 and 2 describe an external heating section employing the belt method, in which a belt member suspended by a plurality of belt-suspending rollers having heat sources therein is brought into contact with a surface of the fixing roller. As described in these publications, the belt member follows the rotation of the fixing roller by the frictional force generated on the surface of the fixing roller.

Patent Publication 1: Japanese Laid-Open Patent Publication No. 2004-198659 (published on Jul. 15, 2004)

Patent Publication 2: Japanese Laid-Open Patent Publication No. 2005-189427 (published on Jul. 14, 2005)

The belt method provides a wider heating nip area with a smaller heat capacity as compared with the roller method. This enables a large amount of heat to be supplied to the surface of the fixing roller, and therefore provides a superior temperature response in fast fixing. A problem of this method, however, is that when the fixing roller is stopped at the end of fixing, the fixing roller is locally heated in a portion where the heating member for heating the belt member is in contact with via the belt member. This advances deterioration of the fixing roller (in the following, such localized overheating will be referred to as overshoot).

That is, in the belt method, a heat supply to the fixing roller is large, and, owning to the fact that a plurality of members, such as the belt member and the belt-suspending rollers are interposed between the heat source and the surface of the fixing roller, there is a large temperature gradient between the heat source and the surface of the belt member. Thus, when the rotation of the fixing roller is stopped and the heat transfer to the fixing roller is cut off instantaneously, the temperature gradient causes temperatures of the belt-suspending rollers and belt members to rise. This causes localized overheating in the fixing roller, in a portion in contact with the belt-suspending rollers via the belt member. The problem of overshoot due to temperature gradient is particularly prominent when the belt-suspending rollers and the endless belt have small heat capacities as it is usually the case.

Further, overshoot disturbs temperature distributions on the surface of the fixing roller. This may cause uneven glossiness in images produced in the next fixing process.

Further, in the system that requires the surface temperature of the fixing roller to be varied according to printed image information, the system first turns off the heat source inside the fixing roller and the heat sources inside the belt-suspending rollers, and then rotates the fixing roller to lower the surface temperature of the fixing roller, if the surface temperature of the fixing roller needs to be decreased during a fixing operation. However, as described above, since the preset temperature of the belt-suspending rollers is higher than the fixing temperature, it takes time to lower the temperature of the fixing roller.

One way to overcome such a problem is to provide an external heating section that can be separated from or brought into contact with the fixing roller. Overshoot can be prevented by separating the external heating section from the fixing roller, either immediately after the rotation of the fixing roller has been stopped, or when the temperature of the fixing roller needs to be lowered. Further, with the external heating section separated from the fixing roller, the heat of the belt-suspending roller does not easily transfer to the fixing roller. This facilitates the temperature drop in the fixing roller.

However, there is a problem in the arrangement in which the external heating section is separated from the fixing roller. Specifically, the belt member deteriorates at an increased rate if the belt member is completely separated from the fixing roller. As described above, the temperature of the heating member is greater than the surface temperature of the fixing member even after the heating, and as such, if the belt member is completely separated from the fixing member, the transferred heat from the heating member concentrates on the belt member in areas around the point of contact with the heating member. This deteriorates the belt member.

Further, in the arrangement in which the belt member is completely separated from the fixing roller, the belt member needs to travel a long distance and therefore requires a large space for the release/contact. This poses space restrictions. Further, since the distance of travel is long, the release/contact mechanism requires a large and complex structure, which makes it difficult to realize the quick release/contact as attained by a simple release/contact mechanism.

Patent Publication 1 describes a release/contact structure for the external heating section, for the purpose of a jamming process and cleaning of the belt member. However, this publication does not describe a specific structure for the release/contact mechanism, nor does it mention which member of the external heating section is separated or made contact. As such, the technique described in Patent Publication 1 cannot be used to solve the problem of accelerated deterioration in the belt member or realize quick release/contact in a small space and at low power.

SUMMARY OF THE INVENTION

An object of the present invention is to provide a fixing apparatus including an external release/contact mechanism that can realize a quick release/contact operation in a small space and at low power without encouraging deterioration of a belt member. The invention also provides an image forming apparatus provided with such a fixing apparatus.

In order to achieve the foregoing objects, there is provided a fixing apparatus including an external heating section that brings an endless belt member into contact with a surface of a rotatable fixing member and supplies heat from the belt member to the fixing member so as to externally heat the fixing member, the fixing apparatus causing a printing medium to pass between the fixing member and a pressure member pressed against the fixing member, so as to fix a toner image formed on the printing medium, the external heating member including: the belt member; a heating member provided inside the belt member and pressed against the fixing member via the belt member; and a release/contact mechanism for causing the heating member to separate from or contact with the fixing member, the belt member and the fixing member being in contact with each other, with the heating member separated from the fixing member by the release/contact mechanism.

An image forming apparatus according to the present invention includes a fixing apparatus according to the present invention.

According to this arrangement, the release/contact mechanism enables the heating member inside the belt member to separate from or contact with the fixing member. By separating the heating member from the fixing member with the release/contact mechanism at the end of a fixing operation for example, it is possible to prevent the problem known as overshoot that occurs when the heating member, having a higher temperature than the fixing member, is pressed against the surface of the fixing member at rest, and that causes localized heating on the surface of the fixing member.

There are cases where the fixing temperature needs to be reduced during a fixing operation. The surface temperature of the fixing member can be effectively lowered by separating the heating member from the fixing member with the release/contact mechanism, and thereby cutting off the heat supply from the heating member.

According to the foregoing arrangement, when the heating member is separated from the fixing member, the belt member and the fixing member are in contact with each other and the belt member follows the rotation of the fixing member.

As described above, the temperature of the heating member remains greater than the surface temperature of the fixing member even after the heating in the fixing process is finished. This raises the temperature of the belt member in a portion in contact with the heating member, and this causes deterioration in this portion of the belt member. In order to suppress such deterioration of the belt member, it is preferable to continue rotating the belt member even after the heating member has been separated from the fixing member. By the rotation, the heat from the heating member is transferred to all parts of the belt member, and deterioration of the belt member can be effectively suppressed. However, if a driving mechanism (driving means) for rotating the belt member even after the heating member has been separated from the fixing member is additionally provided, the size of the fixing apparatus would be increased.

According to an embodiment of the present invention, deterioration of the belt member can be effectively suppressed without additionally providing such a driving mechanism and increasing the size of the fixing apparatus.

The arrangement in which the belt member follows the rotation of the fixing member with the heating member separated from the fixing member can be attained, for example, by so setting the distance by which the heating member is separated from the fixing member as to allow the belt member to follow the rotation of the fixing member, or by providing a pressing member by which the belt member is pressed against the fixing member.

Because the belt member and the fixing member are in contact with each other with the heating member separated from the fixing member, the heating member needs to travel over a shorter distance as compared with the arrangement in which the belt member is completely separated. As a result, a smaller space is required for the release/contact, and quick release/contact can be made in a small space and at low power.

Additional objects, features, and strengths of the present invention will be made clear by the description below. Further, the advantages of the present invention will be evident from the following explanation in reference to the drawings.

DESCRIPTION OF THE EMBODIMENTS

A fixing apparatus of the present invention is applicable to image forming apparatuses such as printers of an electrophotographic system, copying machines, facsimile machines, and MFPs (multifunctional printers).

First Embodiment

Figure 1:
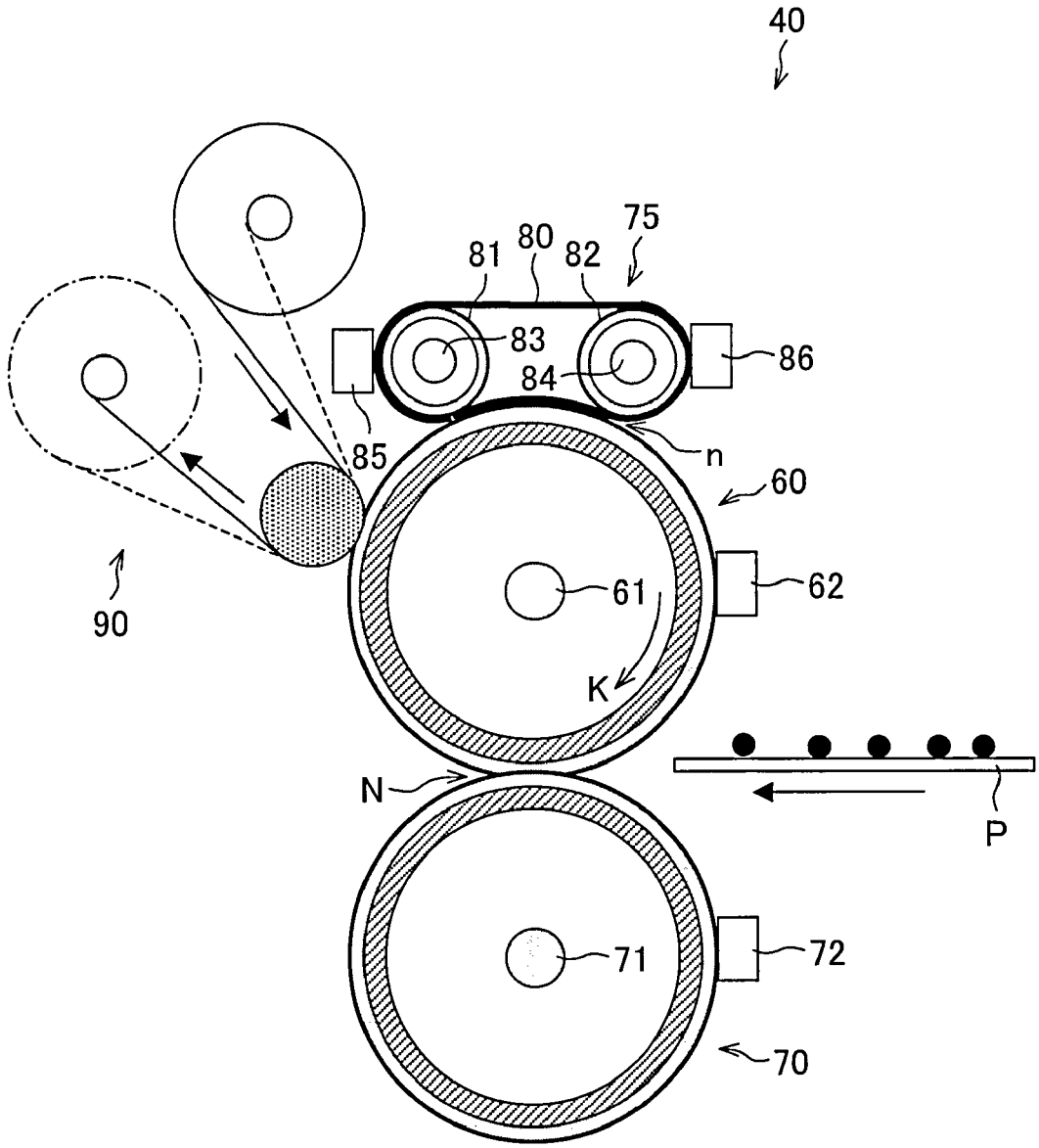
FIG. 1 is a diagram illustrating a structure of a fixing apparatus according to one embodiment of the present invention.
Figure 2:
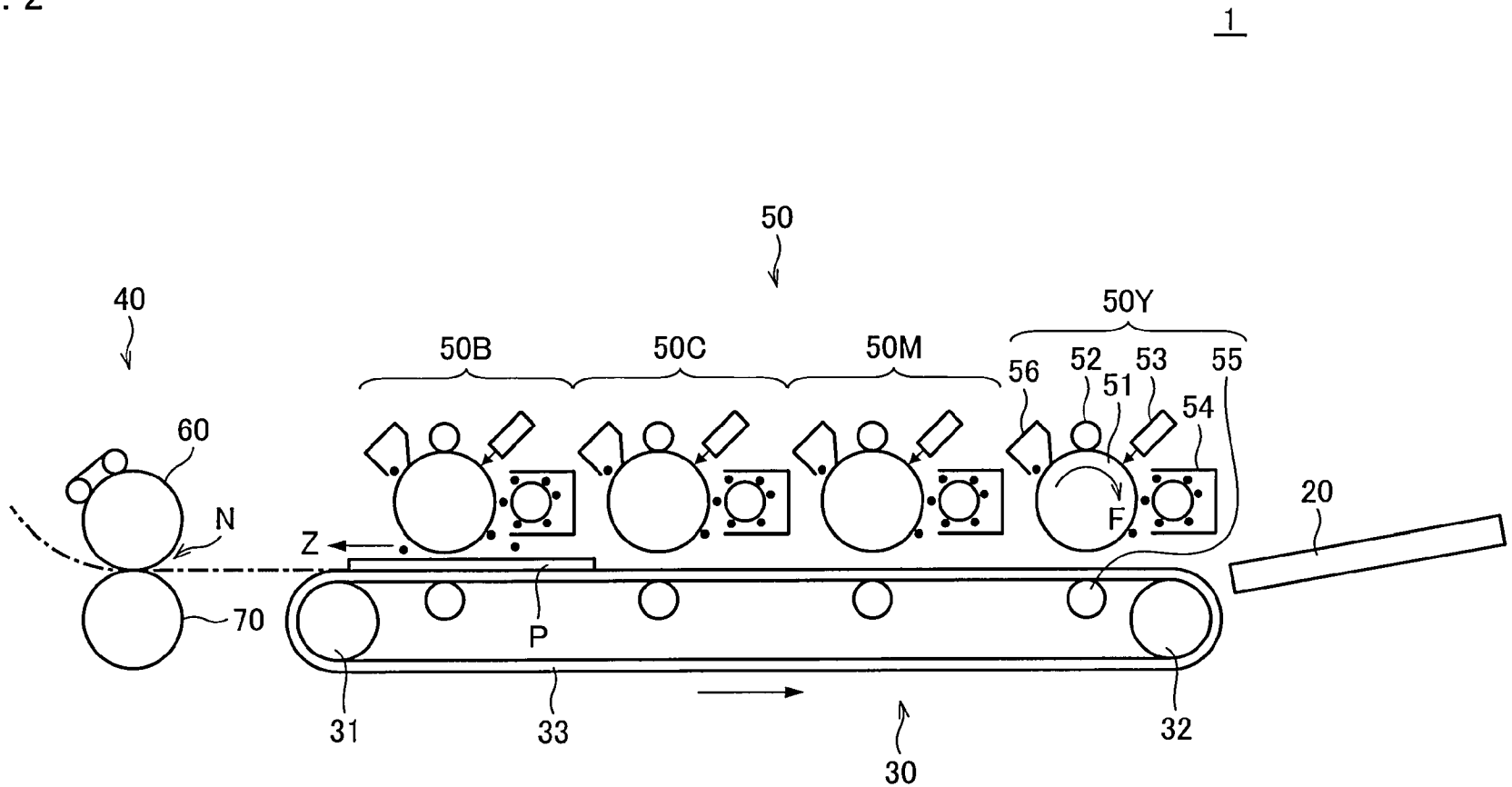
FIG. 2 is a diagram illustrating a structure in a main part of an image forming apparatus provided with the fixing apparatus according to one embodiment of the present invention.

The following will describe one embodiment of the present invention with reference to FIG. 1 through FIG. 5. First, referring to FIG. 2, description is made as to an image forming apparatus provided with a fixing apparatus according to one embodiment of the present invention. FIG. 2 is a diagram illustrating an internal structure of the image forming apparatus.

An image forming apparatus 1 shown in FIG. 2 forms a color image or a monochromatic image on paper (printing medium) P based on image data. In this embodiment, description will be made based on a four-tandem-engine color printer of a dry electrophotographic system. The image data is transmitted via a network or read out by a scanner.

The image forming apparatus 1 includes a visualized image forming section 50, a sheet transport section 30, a fixing apparatus 40, and a paper feed tray 20.

The visualized image forming section 50 includes an yellow visualized image forming unit SOY, a magenta visualized image forming unit 50M, a cyan visualized image forming unit 50C, and a black visualized image forming unit 50B. The yellow visualized image forming unit SOY, the magenta visualized image forming unit 50M, the cyan visualized image forming unit 50C, and the black visualized image forming unit 50B are disposed between the paper feed tray 20 and the fixing apparatus 40, in this order from the paper feed tray 20.

The visualized image forming units SOY, 50M, 50C, and 50B have substantially the same structure, respectively form images of yellow, magenta, cyan, and black based on image data, and transfer the images on paper P that has been transported with a transport belt 33 (described later).

The visualized image forming units 50Y, 50M, 50C, and 50B each include a photoreceptor drum 51. Around the photoreceptor drum 51, there are provided a charge roller 52, a LSU (laser beam scanner unit) 53, a developing unit 54, a transfer roller 55, and a cleaning device 56, along the direction of rotation of the photoreceptor drum 51 (direction of arrow F in FIG. 2).

The photoreceptor drum 51 has a photosensitive material layer on its surface, and rotates in a direction of arrow F. The charge roller 52 is a charger that uniformly (evenly) charges the surface of the photoreceptor drum 51.

The LSU 53 exposes the charged surface of the photoreceptor drum 51 based on an inputted image signal, so as to form an electrostatic latent image. The LSUs 53 of the visualized image forming units SOY, 50M, 50C, and 50B respectively receive image data of yellow, magenta, cyan, and black.

The development unit 54 develops the electrostatic latent image formed on the surface of the photoreceptor drum 51, using a toner-containing developer, so as to form a toner image (visualized image). The developing units 54 of the visualized image forming units SOY, 50M, 50C, and 50B form toner images using developers of yellow, magenta, cyan, and black, respectively. The developer may be a non-magnetic one-component developer (non-magnetic toner), a non-magnetic two-component developer (non-magnetic toner and carrier), or a magnetic developer (magnetic toner), which may be collectively referred to simply as "toner" in the description below.

The transfer roller 55 is disposed on a rear side of the transport belt 33. By the transfer roller 55, the toner image formed on the photoreceptor drum 51 is transferred onto paper P that has been transported with the transport belt 33. The transfer roller 55 has been applied with a bias voltage of the opposite polarity to that of toner. The toner image on the photoreceptor drum 51 is transferred by applying the bias voltage to the paper P.

The cleaning device 56 removes toner that remains on the photoreceptor drum 51 after the image has been transferred onto the paper P.

The sheet transport section 30 includes a driving roller 31 and an idling roller 32, which together suspend the transport belt 33. The transport belt 33 is also a constituting member of the sheet transport section 30. In the sheet transport section 30, the paper P supplied from the paper feed tray 20 is held on the transport belt 33, which then transports the paper P so that the toner images formed by the visualized image forming units 50Y, 50M, 50C, and 50B are transferred one after another on the paper P. By the rotation of the driving roller 31, the transport belt 33 rotates at a predetermined peripheral velocity (355 mm/s). The paper P with the transferred toner images are detached from the transport belt 33 according to the curvature of the driving roller 31, and is transported to the fixing apparatus 40 (the direction is transport is indicated by dashed line in FIG. 2).

The fixing apparatus 40 includes a fixing roller 60 and a pressure roller 70, at least one of which is heated and which are pressed against each other. The fixing apparatus 40 heat-fixes the toner images on the paper P by causing the paper P with unfixed toner images to pass through a fixing nip portion N, which is a point of contact between the fixing roller 60 and the pressure roller 70. The fixing apparatus 40 will be described later in more detail.

The paper P with the toner images fixed thereon by the fixing apparatus 40 is ejected to an ejection tray (not shown) provided outside of the image forming apparatus 1. This completes the image formation process.

The image forming apparatus 1 also includes a control section that controls operations of the respective members and performs image processes on image data. The control section is realized by a microcomputer including at least CPU and RAM, and operates by reading a program stored in a storage medium (not shown).

The following will describe a structure of the fixing apparatus 40 in more detail. FIG. 1 is a cross section illustrating a structure of the fixing apparatus 40. As shown in FIG. 1, the fixing apparatus 40 includes an external heating section (external heating means) 75 and a web cleaning device 90, in addition to the fixing roller 60 and the pressure roller 70.

The fixing roller 60 and the pressure roller 70 are pressed against each other with a predetermined load (here, 600 N), and the fixing nip portion N is formed therebetween (a point of contact between the fixing roller 60 and the pressure roller 70). In the present embodiment, the nip width of the fixing nip portion N (width along the direction of rotation (direction of K in FIG. 1) of the fixing roller 60) is set to 9 mm, for example.

The fixing roller 60 is heated to a predetermined temperature (here 180° C.) so as to heat the paper P as it passes through the fixing nip portion N with the unfixed toner images. The fixing roller 60 has a three-layer structure, in which a metal core, an elastic layer, and a releasing layer are overlaid in this order.

The metal core is made of metal such as iron, stainless steel, aluminum, or copper, or an alloy of such metals. The elastic layer is made of silicone rubber. The releasing layer is made of fluorocarbon resin such as PFA (copolymer of tetrafluoroethylene and perfluoroalkylvinylether) or PTFE (polytetrafluoroethylene).

Inside the fixing roller 60 (inside the metal core) is installed a heater lamp (halogen lamp) 61, which is a heat source for the fixing roller 60. Conduction to the heater lamp 61 is controlled by the control section (not shown). When turned on, the heater lamp 61 emits infrared rays. The infrared radiation is absorbed by the inner periphery of the fixing roller 60, and this heats the whole structure of the fixing roller 60.

The pressure roller 70 is pressed against the fixing roller 60 with a pressing mechanism (not shown) provided at the both ends of the pressure roller 70, so that a predetermined pressure is applied on the fixing nip portion N. As with the fixing roller 60, the pressure roller 70 is also a roller member with a three-layer structure, including a metal core, an elastic layer, and a releasing layer, which are overlaid in this order. The metal core is made of metal such as iron, stainless steel, aluminum, or copper, or an alloy of such metals. The elastic layer is made of a silicone rubber or the like. The releasing layer is made of PFA or PTFE.

In the present embodiment, a heater lamp 71 is provided also inside the metal core of the pressure roller 70. Conduction to the heater lamp 71 is controlled by the control section (not shown). When turned on, the heater lamp 71 emits infrared rays. The infrared radiation is absorbed by the inner periphery of the pressure roller 70, and the whole structure of the pressure roller 70 is heated.

The external heating section 75 includes an endless external heating belt (belt member) 80, and heat rollers (heating members) 81 and 82, which are a pair of belt-suspending rollers that suspend the external heating belt 80. As will be described later in detail, there is also provided a release/contact mechanism (release/contact means) by which the heat rollers 81 and 82 are separated from or brought into contact with the surface of the fixing roller 60 via the external heating belt 80.

The external heating belt 80, by being heated to a predetermined temperature (here, 210° C.), is brought into contact with the surface of the fixing roller 60 to heat the surface of the fixing roller 60. The rear side of the external heating belt 80 is in contact with the heat rollers 81 and 82, from which heat is supplied.

The external heating belt 80 is provided on the periphery of the fixing roller 60, the upstream side of the fixing nip portion N in the direction of rotation of the fixing roller 60 (direction of arrow K in FIG. 1). By the pressing mechanism to be described later, the external heating belt 80 is pressed against the fixing roller 60 with a predetermined pressure (here, 40 N), and a heating nip portion n is formed at the point of contact with the fixing roller 60. In the present embodiment, the nip width of the heating nip portion n (width along the direction of rotation of the fixing roller 60) is set to 20 mm, for example.

The external heating belt 80 is an endless belt with a bilayer structure, in which a releasing layer, such as a synthetic resin material that provides good heat resistance and good release (for example, fluorocarbon resin such as PFA or PTFE), is formed around a surface of a hollow cylindrical base material, such as polyimide or other heat-resistant resins, or metal such as stainless steel or nickel. In order to reduce the skew force of the external heating belt 80, the inner surface of the belt base material may be coated with fluorocarbon resin, for example.

The heat rollers 81 and 82 have hollow cylindrical cores that are made of metal such as aluminum or iron. In order to reduce the skew of the external heating belt 80, the surface of the metal core may be coated with fluorocarbon resin, for example.

Inside the heat rollers 81 and 82 are provided heater lamps 83 and 84, respectively, as heat sources. When turned on by the control section (not shown), the heater lamp 83 and 84 emit infrared rays. The infrared radiation is absorbed by the inner periphery of the heat rollers 81 and 82, and this heats the whole structure of the heat rollers 81 and 82. The external heating belt 80 suspended by the heat rollers 81 and 82 is also heated.

On the periphery of the fixing roller 60, there is provided a thermistor (temperature detecting means) 62. A thermistor 72 is provided on the periphery of the pressure roller 70. On the outer surface of the external heating belt 80, there are provided a thermistor 85 and a thermistor 86, respectively facing the heat roller 81 and the heat roller 82.

Based on outputs of the thermistors 62, 72, 85, and 86, the control section (not shown) detects surface temperatures of the fixing roller 60, the pressure roller 70, and the portions of the external heating belt 80 where the thermistors 85 and 86 are provided. The control section then controls power supply to the heater lamps 61, 71, 83, and 84 corresponding to the respective thermistors 62, 72, 85, and 86, so as to bring the surface temperatures to target temperatures.

In the present embodiment, the control section is installed in the image forming apparatus 1 and controls power supply or other conditions of the heater lamps 61, 71, 83, and 84. However, the control section may be provided in the fixing apparatus 40 to serve these purposes.

Though not shown in FIG. 1, a driving force from a driving motor (driving source) is transmitted to the rotational axis at an end of the fixing roller 60, so that the fixing roller 60 rotates in a direction of K shown in FIG. 1. During a fixing operation, the pressure roller 70, by being pressed against the fixing roller 60, follows the rotation of the fixing roller 60 with the frictional force generated between the fixing roller 60 and the pressure roller 70. As such, the pressure roller 70 rotates in the opposite direction of K.

The external heating belt 80 in the external heating section 75 also follows the rotation of the fixing roller 60 by the frictional force generated at the point of contact with the fixing roller 60. The external heating belt 80 also rotates in the opposite direction of K. The surfaces of the heat rollers 81 and 82 are in contact with the rear side of the external heating belt 80, and therefore the heat rollers 81 and 82 rotate by following the rotation of the external heating belt 80.

The printing paper P is transported in such a manner that the surface with the toner images is in contact with the fixing roller 60, and that the other side is in contact with the pressure roller 70, the contact being made at the fixing nip portion N. The toner images formed on the printing paper P are fixed on the printing paper P with heat and pressure. The fixing speed, which is the speed at which the printing paper P passes through the fixing nip portion N, is the same as the processing speed (sheet transport speed). In the present embodiment, the fixing speed is 355 mm/s. The copying speed, which is the number of continuously fed sheets per minute, is 70 sheets/min in the present embodiment.

Figure 3:
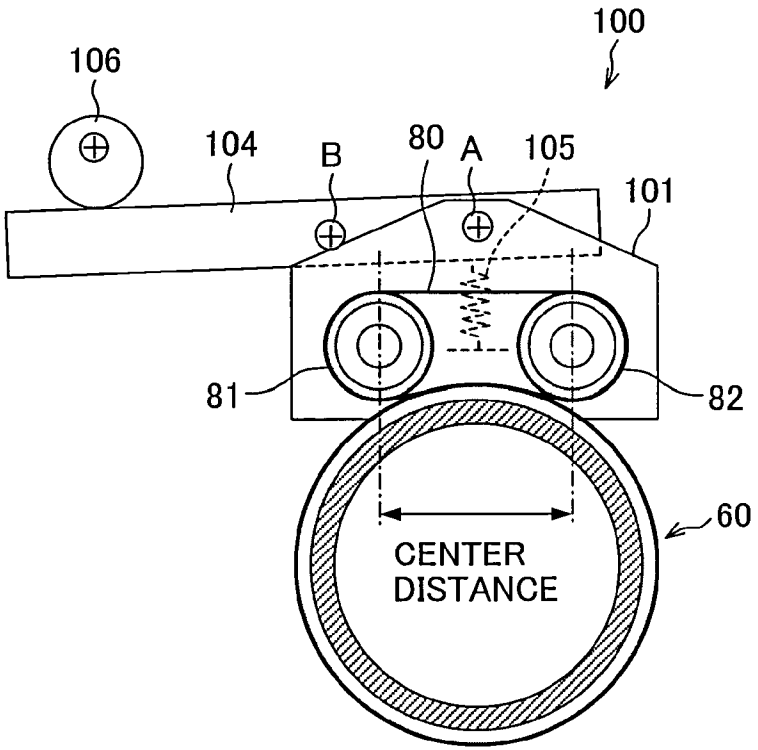
FIGS. 3(*a*) and 3(*b*) are diagrams illustrating a structure of a support section for an external heating section provided in the fixing apparatus.
Figure 3:
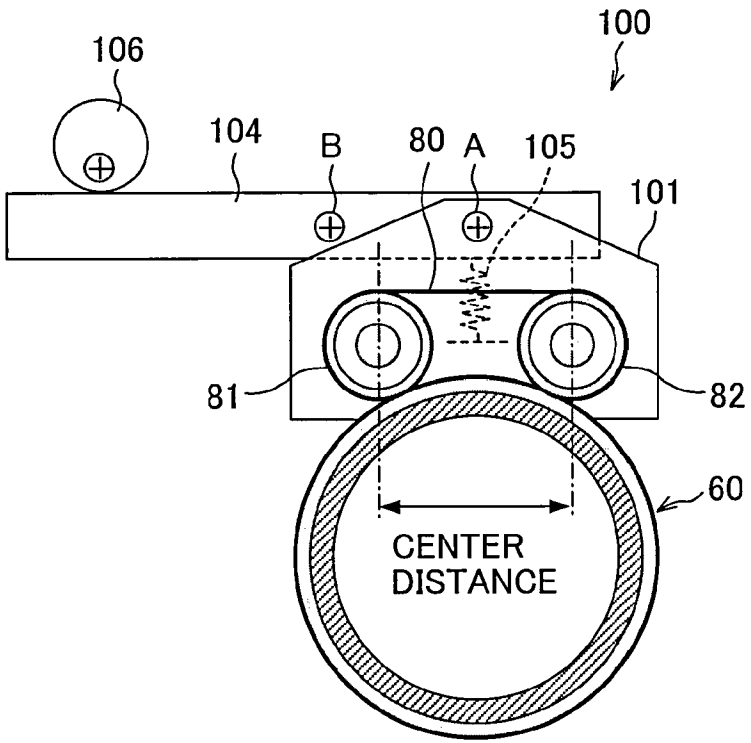
Figure 4:
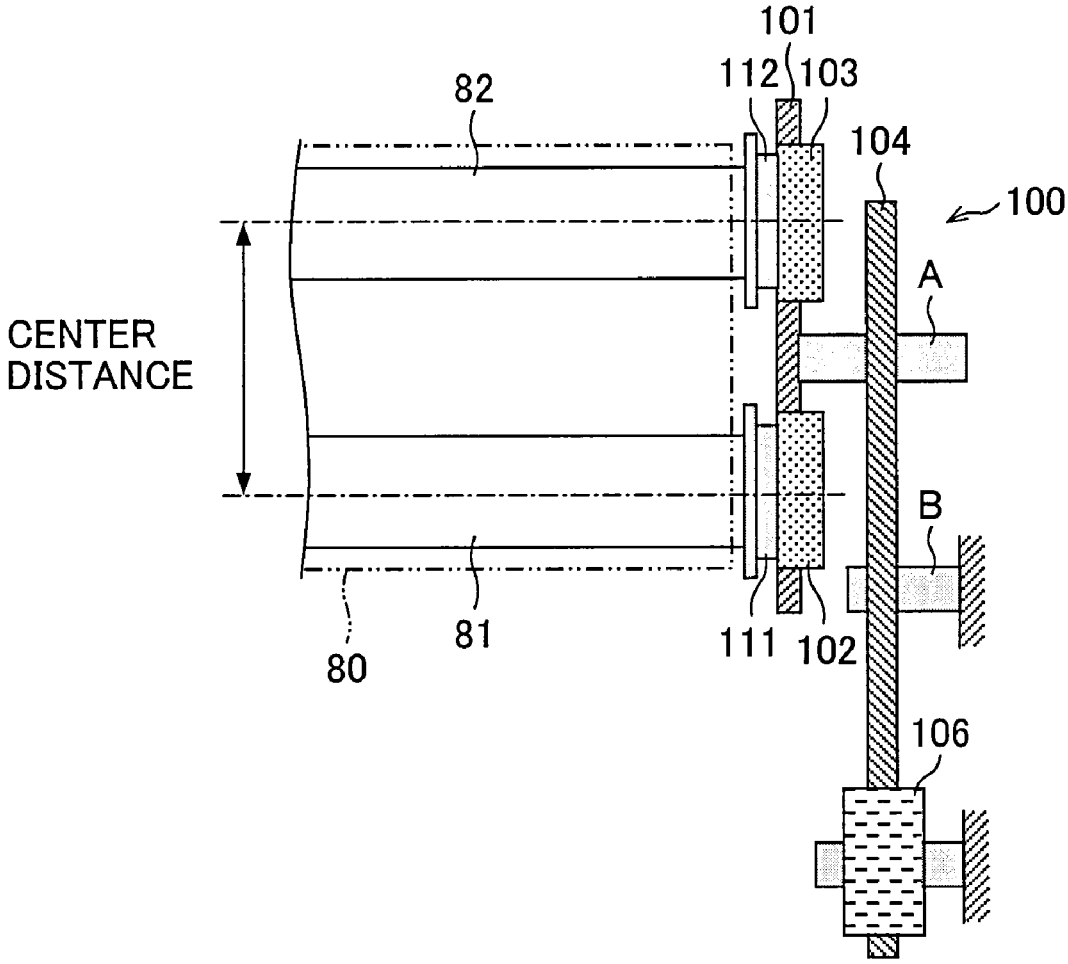
FIG. 4 is an upper view of the support section for the external heating section.

The following describes a release/contact mechanism 100 by which the heat rollers 81 and 82 are separated from or brought into contact with the fixing roller 60. FIGS. 3(*a*) and 3(*b*) are diagrams illustrating a structure of a support section in the external heating section 75. FIG. 4 is an upper view of the support section. The release/contact mechanism 100 is provided in the support section.

The heat rollers 81 and 82 suspending the external heating belt 80 are rotably supported by bearings 102 and 103, respectively, that are mounted on a side frame 101. The bearings 102 and 103 are anchored on the side frame 101 with a predetermined center distance. This ensures parallelism between the heat rollers 81 and 82. In the present embodiment, the heat rollers 81 and 82 are disposed with a parallelism tolerance no greater than 100 μm.

The side frame 101 is rotably supported on an arm 104 at a fulcrum A. The arm 104 is rotably mounted on an anchor, such as a main frame (not shown), at a fulcrum B. One end of a coil spring 105 is attached to the fulcrum A or in the vicinity of the fulcrum A. The other end of the coil spring 105 is attached to an anchor such as a main frame. The arm 104 and the side frame 101 are spring loaded toward the fixing roller 60 by the elasticity of the coil spring 105. In the present embodiment, as shown in FIG. 3(*a*), the pressure rollers 81 and 82 supported on the side frame 101 are pressed against the fixing roller 60 under the same load by which the side frame 101 is spring loaded toward the fixing roller 60.

At an end of the arm 104 opposite the side frame 101 and with the fulcrum B in between, there is provided an eccentric cam 106, which is in contact with the arm 104. The eccentric cam 106 is provided on the side of the arm 104 opposite the fixing roller 60.

With the heat rollers 81 and 82 pressed against the fixing roller 60 as shown in FIG. 3(*a*), rotating the eccentric cam 106 by 180° pushes the arm 104 at the opposite end with respect to the side frame 101, with the result that the arm 104 rotates about the fulcrum B. By the rotation, the end of the arm 104 where the side frame 101 is provided is lifted upward and the coil spring 105 stretches. This moves the fulcrum A away from the fixing roller 60, and the heat rollers 81 and 82 are separated from the fixing roller 60.

In this manner, the heat rollers 81 and 82 can be brought into contact with or separated from the fixing roller 60 by the displacement of the side frame 101, which is caused by the rotation of the arm 104 initiated by the rotation of the eccentric cam 106. In sum, the release/contact mechanism 100 is realized by the foregoing members, namely, the side frame 101 that supports the bearings 102 and 103 of the heat rollers 81 and 82; the arm 104 that supports the side frame 101; the eccentric cam 106 that rotates the arm 104; and the coil spring 105 by which the arm 104 is spring loaded toward the fixing roller 60.

On the inner side of the bearings 102 and 103, the heat rollers 81 and 82 are respectively provided with skew regulating members 111 and 112 for preventing the external heating belt 80 from wobbling. In the event where the external heating belt 80 wobbles, the skew regulating members 111 and 112 follow the rotation of the external heating belt 80 at an end portion thereof. This is intended to regulate a skew and prevent abrasion or cracking caused by sliding at the end portion of the external heating belt 80.

In the present embodiment, the external heating belt 80 is a polyimide base material (UPILEX®-S, UBE INDUSTRIES, LTD.), 90 μm thick, whose surface has been coated with a 20 μm thick releasing layer of fluorocarbon resin containing PTFE and PFA.

The fixing roller 60 has an aluminum core around which a silicone rubber layer, 3 mm thick, is formed as an elastic layer, which is further coated with a releasing layer, for which a PFA tube of 30 μm thick was used. The fixing roller 60 has an outer diameter of 50 mm.

The pressure roller 70 has an aluminum core around which a silicone rubber layer, 2 mm thick, is formed as an elastic layer, which is further coated with a 30 μm thick PFA tube. The fixing roller 70 has an outer diameter of 50 mm as does the fixing roller 60.

The heat rollers 81 and 82 each have a 0.75 mm thick aluminum core, which is coated with a 20 μm thick layer of fluorocarbon resin containing PTFE and PFA. The outer diameters of the heat rollers 81 and 82 are 15 mm. The heat rollers 81 and 82 are disposed with a center distance of 23.0 mm.

The external heating belt 80 has a peripheral length (inner peripheral length) of 94.24 mm (at room temperature). The external heating belt 80 is suspended by the heat rollers 81 and 82 that are disposed at the fixed center distance. The external heating belt 80 is pressed against the fixing roller 60 under a load of 40 N.

With the external heating belt 80 in contact with the fixing roller 60, there is a distance of 28 mm between the fulcrum A and the surface of the fixing roller 60, and a distance of 13 mm between the fulcrum B and the fulcrum A. The distance between the fulcrum B and the point on the arm 104 where the eccentric cam 106 is in contact with is 31 mm.

When the displacement (separation distance) of the arm 104 at the fulcrum A in separating the heat rollers 81 and 82 is 2 mm, the displacement of the arm 104 at the point of contact with the eccentric cam 106 is 4.8 mm. When the fixing roller 60 is at rest, the contact width between the external heating belt 80 and the fixing roller 60 (heating nip area) is about 5 mm. The contact width varies depending upon an acquired curvature of the external heating belt 80 or temperature. Generally, the contact width increases when the external heating belt 80 is under heat, because belt members such as the external heating belt 80 stretch to increase the peripheral length when heated.

When the displacement (separation length) of the arm 104 at the fulcrum A is 3 mm, there will be hardly any contact between the external heating belt 80 and the fixing roller 60, i.e., the external heating belt 80 is completely separated from the fixing roller 60. In this case, the displacement of the arm 104 at the point of contact with the eccentric cam 106 is 7.2 mm.

When the fixing roller 60 is driven in contact with part of the external heating belt 80, the frictional force between the fixing roller 60 and the external heating belt 80 pulls the heat roller 81, which is disposed on the upstream side in the direction of rotation of the fixing roller 60, toward the surface of the fixing roller 60. As a result, the external heating belt 80 is brought into contact with the fixing roller 60 in a portion closer to the heat roller 81.

In this case, the external heating belt 80 is pressed against the fixing roller 60 more strongly as compared with the case where the contact is made between the heat rollers 81 and 82. This rotates the external heating belt 80 more easily. With the temperature of the fixing roller 60 adjusted to 190° C., and the heat rollers 81 and 82 at 210° C., the external heating belt 80 follows the rotation of the fixing roller 60 when the fixing roller 60 is rotated at the rotational speed (peripheral velocity) of 355 mm/sec and with a separation length of 2 mm. Note that, the external heating belt 80 does not rotate when the separation length is 3 mm.

Figure 5:
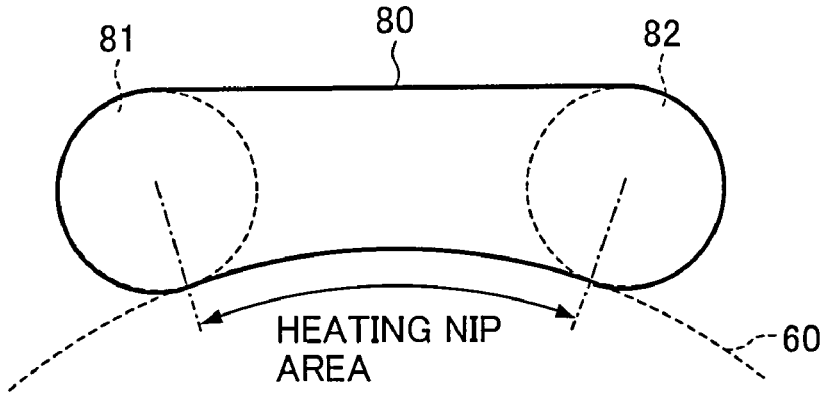
FIGS. 5(*a*) through 5(*c*) are diagrams representing how an external heating belt is brought into contact with a fixing roller.
Figure 5:
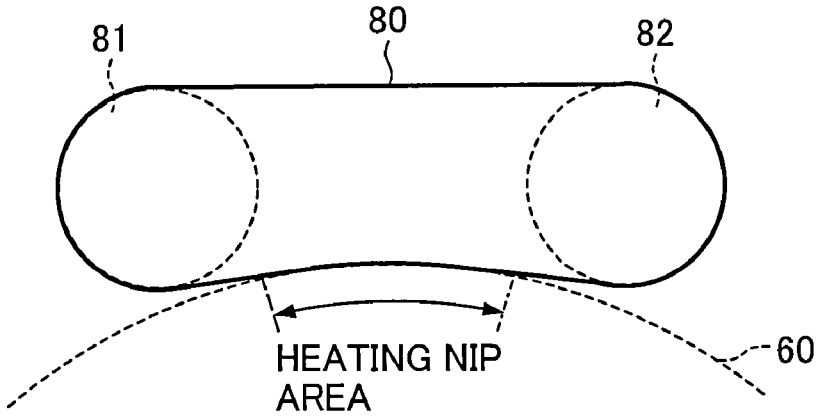
Figure 5:
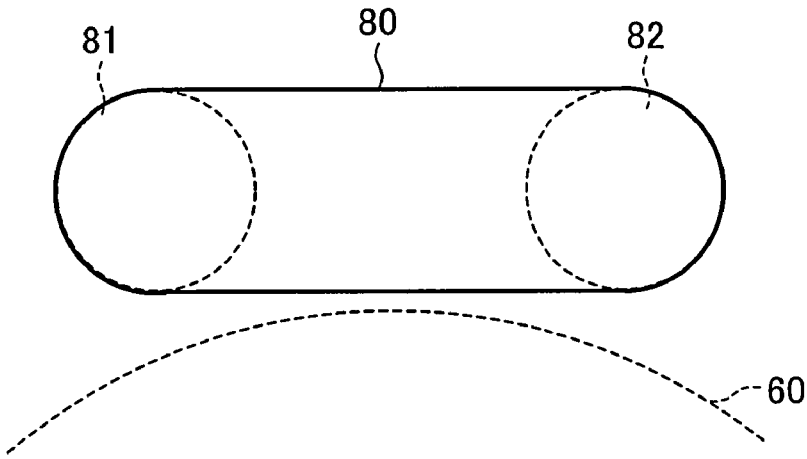

FIGS. 5(*a*) through 5(*c*) represent how the separation length between the external heating belt 80 and the fixing roller 60 is related to the contact width. FIG. 5(*a*) shows a state in which the external heating belt 80 is not separated from the fixing roller 60. FIG. 5(*b*) shows a state in which the external heating belt 80 is partially in contact with the fixing roller 60. This state is assumed when the separation length is 2 mm or less.

In FIG. 5(*b*), the heat rollers 81 and 82 are not in contact with the fixing roller 60 via the external heating belt 80. As such, the heat of the heat rollers 81 and 82 does not transfer to the fixing roller 60 via the external heating belt 80, when the fixing roller 60 is not rotating. This is not the case when the fixing roller 60 is rotating. In this case, the external heating belt 80 follows the rotation of the fixing roller 60, and as such the heat of the heat rollers 81 and 82 transfer to the fixing roller 60 as the heated portion of the external heating belt 80 reaches the point of contact with the fixing roller 60. However, compared with the state shown in FIG. 5(*a*) in which the external heating belt 80 is not separated from the fixing roller 60, the external heating belt 80 has a shorter contact width. This suppresses the heat transfer to the fixing roller 60, and the temperature of the fixing roller drops more quickly. Further, since the external heating belt 80 follows the rotation of the fixing roller 60, deterioration caused by overheating at the point of contact with the heat rollers 81 and 82 does not occur.

FIG. 5(*c*) represents a comparative example in which the external hating belt 80 is not in contact with the fixing roller 60. In the present embodiment, this state is assumed when the separation length is 3 mm.

The effect of surface temperature drop in the fixing roller 60, and whether or not the external heating belt 80 follows the rotation of the fixing roller 60 are determined by the contact width, the pressure acting between the external heating belt 80 and the fixing roller 60, and the ease of rotation of the external heating belt 80. These parameters depend on such factors as the surface materials at the point of contact, temperature, peripheral velocity, the relation between the peripheral length of the external heating belt 80 and the center distance, the position of the fulcrum A, and the acquired curvature of the external heating belt 80. It is therefore preferable that the separation length be suitably adjusted taking into account these factors, after all members have been assembled together.

In the release/contact mechanism as structured above, only the heat rollers 81 and 82 are separated from the fixing roller 60 with the external heating belt 80 in between, i.e., without completely separating the external heating belt 80 from the fixing roller 60. That is, a shorter distance is required for the release/contact. Further, compared with the structure in which the external heating belt 80 is completely separated from the fixing roller 60, less space is required for the release/contact of the external heating section 75, thereby reducing power consumption.

When the rotation of the fixing roller 60 is stopped during standby after the fixing process, the foregoing arrangement enables the surface of the fixing roller 60 from being locally heated with the heat rollers 81 and 82, provided that the external heating belt 80 is separated by the distance of 1 mm or greater. Further, a lower fixing temperature can be used as compared with the case where the external heating belt 80 is not separated from the fixing roller 60. When the separation length is 2 mm or less, the external heating belt 80 can follow the rotation of the fixing roller 60. This prevents local deterioration of the external heating belt 80 caused by the heat rollers 81 and 82.

In the arrangement where the external heating belt 80 is completely separated from the fixing roller 60, the long separation distance it requires makes the structure of the release/contact mechanism complex. However, with the external heating belt 80 maintained in contact with the fixing roller 60 as in the present embodiment, the heat rollers 81 and 82 need to be moved only by a short distance, and therefore the structure of the release/contact mechanism 100 can be simplified. With the simple structure, the release/contact mechanism 100 can operate more quickly than a release/contact mechanism having a large and complex structure. More specifically, the short distance requires less movement for the arm 104, and reduces the size of the eccentric cam 106 and the driving force therefor. This reduces the size and power consumption of the fixing apparatus 40 and allows for quicker release/contact.

Further, in the release/contact mechanism 100, since the side frame 101 defining the positions of the heat rollers 81 and 82 is moved, the heat rollers 81 and 82 can be quickly separated from the fixing roller 60, together with the external heating belt 80.

In the fixing apparatus 40 shown in FIG. 1(*a*), the external heating belt 80 follows the rotation of the fixing roller 60. During the fixing operation (printing paper passing through the fixing nip portion n), the external heating belt 80 generally rotates and heats the fixing roller 60, with the heat rollers 81 and 82 in contact with the fixing roller 60. At the end of the fixing operation, the fixing roller 60 and the external heating belt 80 stop rotating, and await further instructions at a maintained predetermined temperature (standby state) so that the next print job can be started at the input of the next print signal (copy signal), provided that the power supply to the image forming apparatus 1 is not cut off. That is, even after the fixing operation, the external heating belt 80 remains heated without undergoing rotation. The external heating belt 80 is allowed to cool to room temperature when the power supply to the image forming apparatus 1 is finally cut off.

If the external heating belt 80 is cooled to room temperature after the fixing operation in the state shown in FIG. 1(*a*), i.e., with the heat rollers 81 and 82 in contact with the fixing roller 60 and therefore applying a sufficient tension to the external heating belt 80, the external heating belt 80 deforms to assume the original shape of when it is suspended by the heat rollers 81 and 82 (belt-suspending rollers).

If the external heating belt 80 that has undergone deformation is rotated for heating, the rotation of the external heating belt 80 would be unstable. In the worst case, the external heating belt 80 stops and its ability to heat the fixing roller 60 suffers greatly. In other cases, serious problems may be caused such as damage to the external heating belt 80 due to heat.

Such problems can be avoided by separating the heat rollers 81 and 82 from the fixing roller 60 at the end of the fixing operation as shown in FIG. 1(*b*), i.e., by reducing the tension in the external heating belt 80. In this case, no substantial deformation in the circumferential direction occurs in the external heating belt 80 suspended by the heat rollers 81 and 82, even when the external heating belt 80 is allowed to cool.

In sum, in the arrangement in which the external heating belt 80 is suspended by the heat rollers 81 and 82 that are disposed with a fixed center distance as shown in FIG. 2, and in which the heat rollers 81 and 82 are in contact with the fixing roller 60, the circumferential deformation in the external heating belt 80 caused by the tension exerted by the heat rollers 81 and 82 can be prevented by separating the heat rollers 81 and 82 from the fixing roller 60, at least when the external heating belt 80 is not rotating, and thereby reducing the tension in the external heating belt 80.

Second Embodiment

Figure 6:
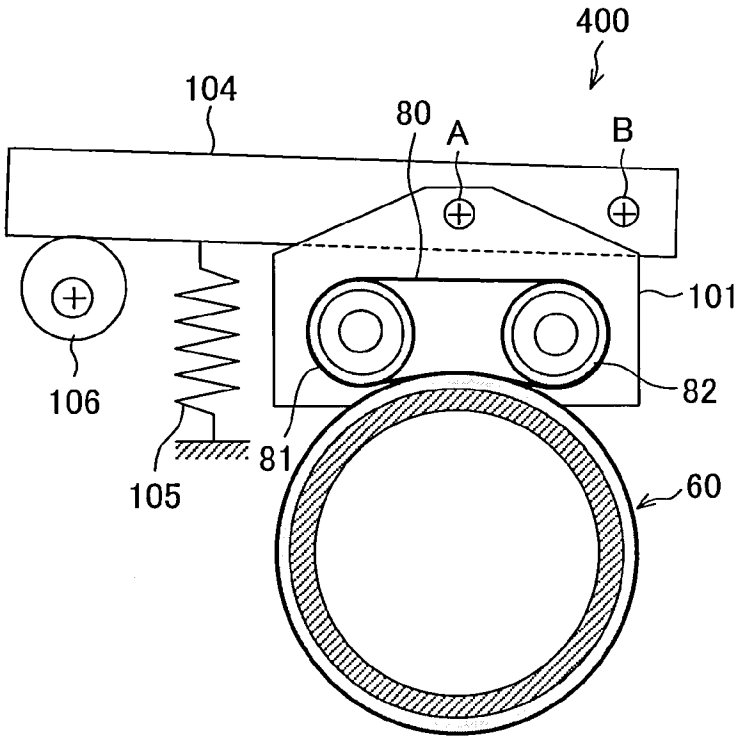
FIGS. 6(*a*) and 6(*b*) are diagrams illustrating a structure of a support section for an external heating section in a fixing apparatus according to another embodiment of the present invention.
Figure 6:
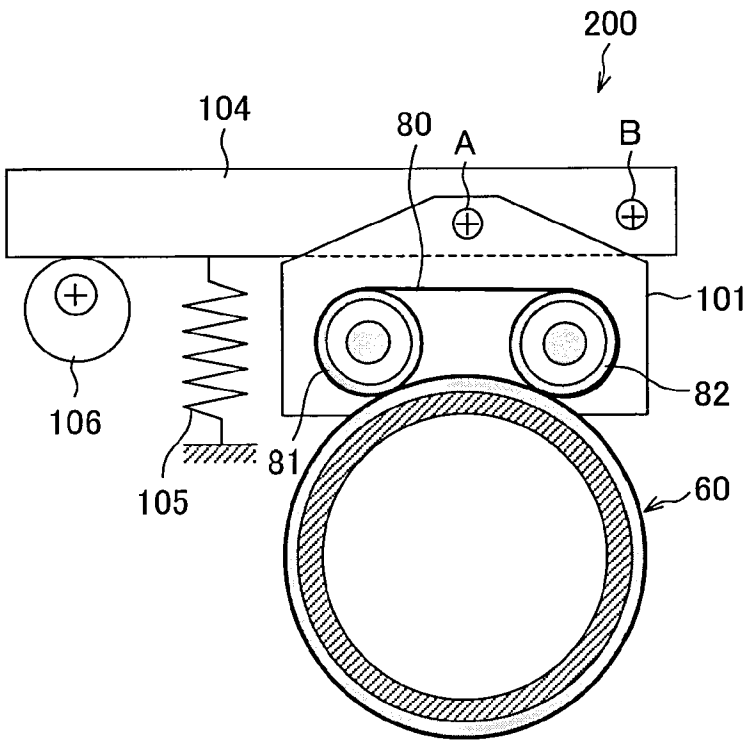
Figure 7:
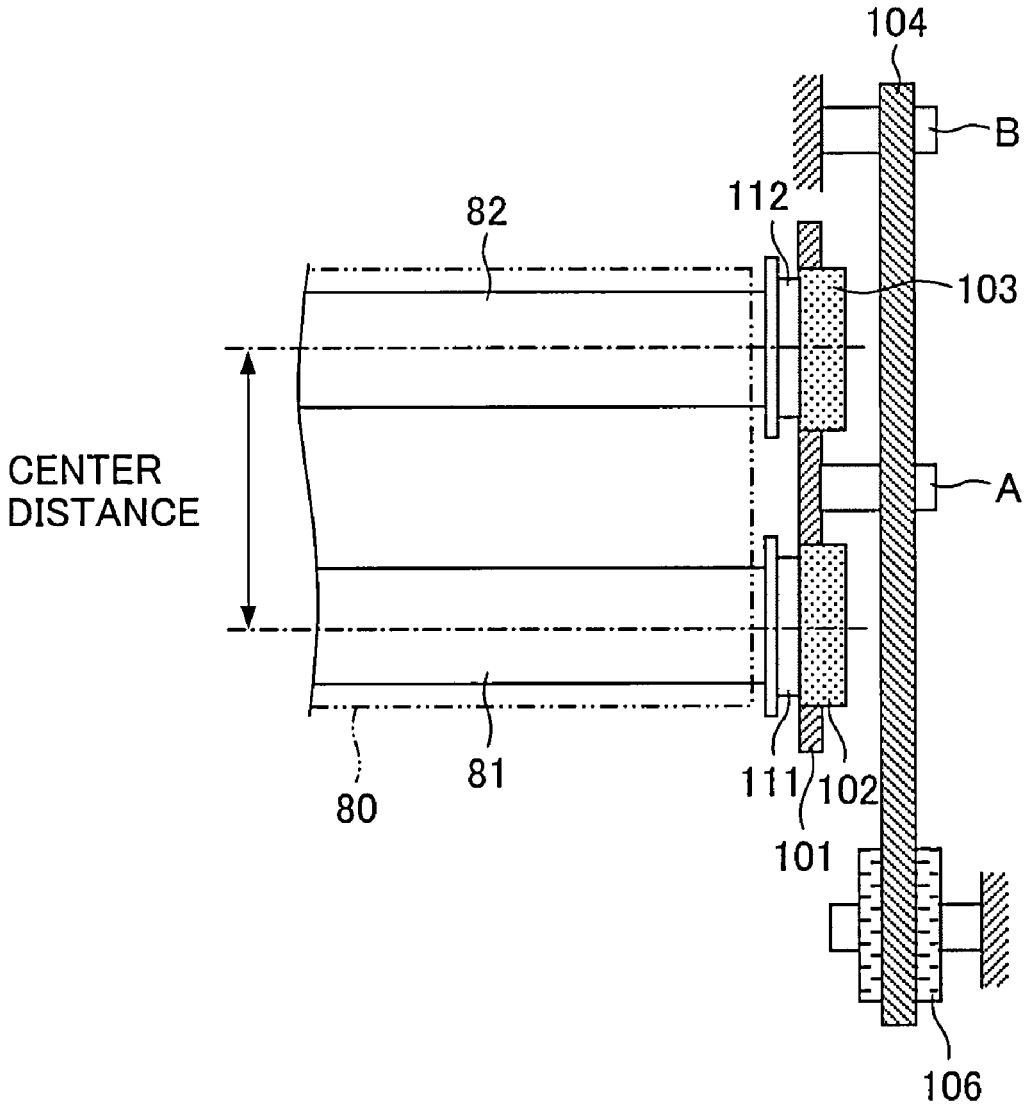
FIG. 7 is an upper view of the support section for the external heating section shown in FIG. 6.

The following will describe another embodiment of the present invention with reference to FIG. 6 and FIG. 7. For convenience of explanation, constituting members having the same functions as those described in the First Embodiment are given the same reference numerals and explanations thereof are omitted here.

An image forming apparatus of the present embodiment differs from the image forming apparatus 1 of the First Embodiment only in the arrangement of the release/contact mechanism by which the heat rollers 81 and 82 are separated from or brought into contact with the surface of the fixing roller 60 in the fixing apparatus 40. As such, the following description deals with only the release/contact mechanism.

FIGS. 6(*a*) and 6(*b*) are diagrams illustrating a structure of a support section for the external heating section 75. FIG. 4 is an upper view of the support section. A release/contact mechanism 200 is provided in the support section.

The release/contact mechanism 200 differs from the release/contact mechanism 100 in the position of fulcrum B in the arm 104, the mount position of the eccentric cam 106, and the installed position of the coil spring 105 with respect to the arm 104. In the release/contact mechanism 200, the fulcrum B for the arm 104 is provided at the opposite end with respect to the eccentric cam 106, and the fulcrum A for the side frame 101 is provided between the fulcrum B and the eccentric cam 106. The eccentric cam 106 is provided on the same side of the arm 104 where the fixing roller 60 is installed, and the coil spring 105 by which the arm 104 is spring loaded toward the fixing roller 60 has an end attached between the fulcrum B and the eccentric cam 106. As shown in FIG. 6(*a*), the pressure rollers 81 and 82 supported on the side frame 101 are pressed against the fixing roller 60 under the same load by which the side frame 101 is spring loaded toward the fixing roller 60, as in the First Embodiment.

When the eccentric cam 106 is rotated 180° in the state shown in FIG. 6(*a*) in which the heat rollers 81 and 82 are in contact with the fixing roller 60, the eccentric cam 106 lifts the arm 104 at the opposite end with respect to the fulcrum B. In response, the coil spring 105 stretches and the fulcrum A moves away from the fixing roller 60, with the result that the heat rollers 81 and 82 separate from the fixing roller 60, as shown in FIG. 6(*b*).

Third Embodiment

Figure 8:
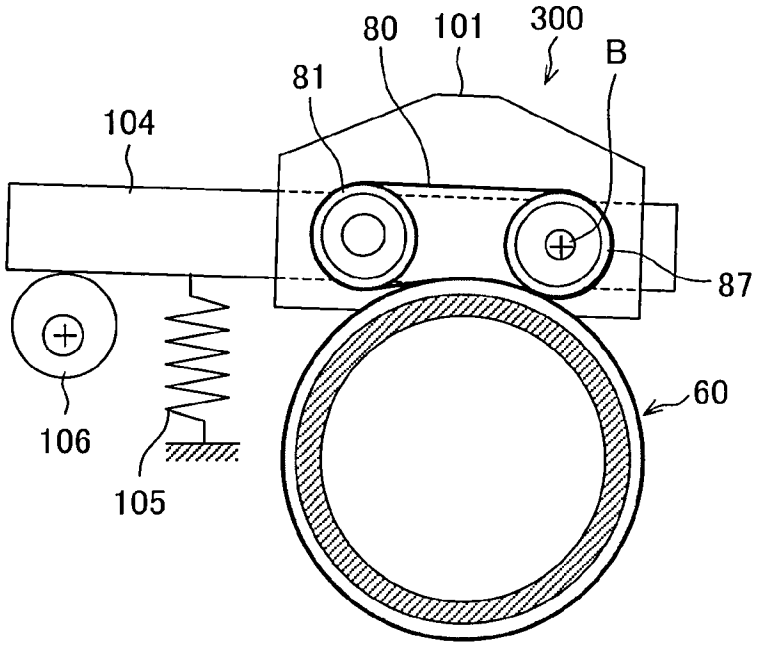
FIGS. 8(*a*) and 8(*b*) are diagrams showing a structure of a support section for an external heating section in a fixing apparatus according to yet another embodiment of the present invention.
Figure 8:
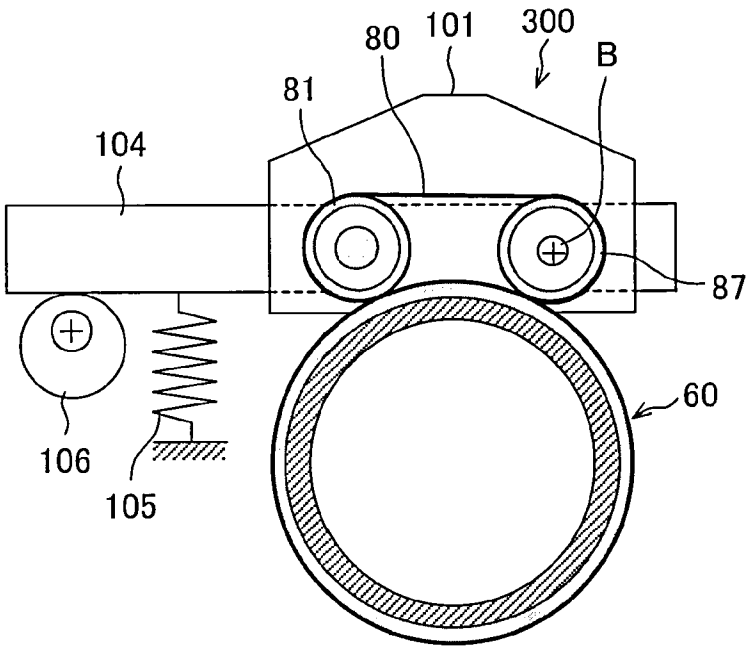

The following will describe another embodiment of the present invention with reference to FIG. 8. Note that, constituting members having the same functions as those described in the foregoing First and Second Embodiments are given the same reference numerals and explanations thereof are omitted here.

An image forming apparatus of the present embodiment differs from the image forming apparatus 1 of the First Embodiment only in the arrangements of the external heating section and the release/contact mechanism in the fixing apparatus 40. As such, the following description only deals with the external heating section and the release/contact mechanism.

FIGS. 8(*a*) and 8(*b*) are diagrams illustrating a structure of a support section for an external heating section 76. A release/contact mechanism 300 is provided in the support section.

Instead of the heat roller 82, the external heating section 76 includes a support roller (pressing member) 87 that is not provided with the heater lamp 84 inside as a heat source. The support roller 87 does not differ from the heat roller 82 in other respects. For example, the support roller 87 is also rotably supported by the bearing 103 supported on the side frame 101 (see FIGS. 4 and 7), and rotates with the heat roller 81 following the rotation of the external heating belt 80 suspended by these rollers.

In the release/contact mechanism 300, the side frame 101 is anchored on the arm 104, and the fulcrum B of the arm 104 is positioned on the rotational axis of the support roller 87. The center distance between the support roller 87 and the fixing roller 60 is set such that these rollers are pressed against each other under a certain pressure. The eccentric cam 106 and the coil spring 105 are positioned in the same manner as in the release/contact mechanism 200; the eccentric cam 106 being provided on the same side of the arm 104 where the fixing roller 60 is installed, and an end of the coil spring 105 being attached between the fulcrum B and the eccentric cam 106. As shown in FIG. 8(*a*), the heat roller 81 and the support roller 87 are pressed against the fixing roller 60 by being supported on the side frame 101 that is spring loaded toward the fixing roller 60, as in the foregoing embodiments.

When the eccentric cam 106 is rotated 180° in the state shown in FIG. 8(*a*) in which the heat roller 81 and the support roller 87 are in contact with the fixing roller 60, the eccentric cam 106 lifts the arm 104 at the opposite end with respect to the fulcrum B. In response, the coil spring 105 stretches and the heat roller 81 moves away and separates from the fixing roller 60, with the result that the heat roller 81 separates from the fixing roller 60, as shown in FIG. 8(*b*). Since the fulcrum B is at the center of the support roller 87, the center distance between the support roller 87 and the fixing roller 60 does not change and the pressure against the fixing roller 60 remains the same.

In the external heating section 76 in the image forming apparatus of the present embodiment, only one of the belt-suspending rollers is used as a heat roller by providing a heat source inside it, and the release/contact mechanism 300 moves only the belt-suspending roller (heat roller 81) provided with the heat source, in order to lower the fixing temperature or avoid the adverse effect of the overshoot caused by the heating of the fixing roller 60 with the external heating section 76.

Because only the heated belt-suspending roller is moved, the release/contact mechanism 300 requires less movement as compared with the release/contact mechanisms 100 and 200 that move all of the belt-suspending rollers. This further reduces size of the fixing apparatus and power consumption of the release/contact mechanism.

Further, since the support roller 87 is pressed against the fixing roller 60 at all times, it is ensured that the external heating belt 80 between the support roller 87 and the fixing roller 60 follow the rotation of the fixing roller 60. That is, with the foregoing structures of the external heating section 76 and the release/contact mechanism 300, the effects obtained by the driven rotation of the external heating belt 80 can be obtained more reliably.

Fourth Embodiment

Figure 9:
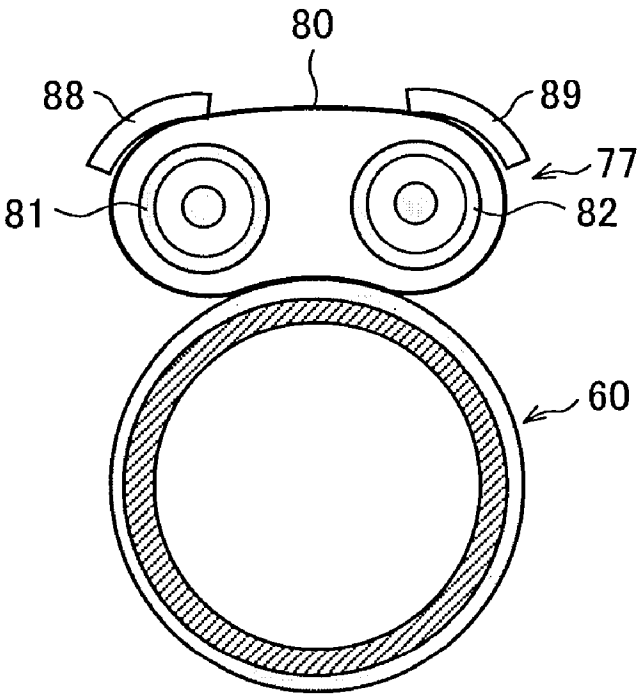
FIGS. 9(*a*) and 9(*b*) are diagrams representing positions of a heat roller and an external heating belt in a fixing apparatus according to still another embodiment of the present invention.
Figure 9:
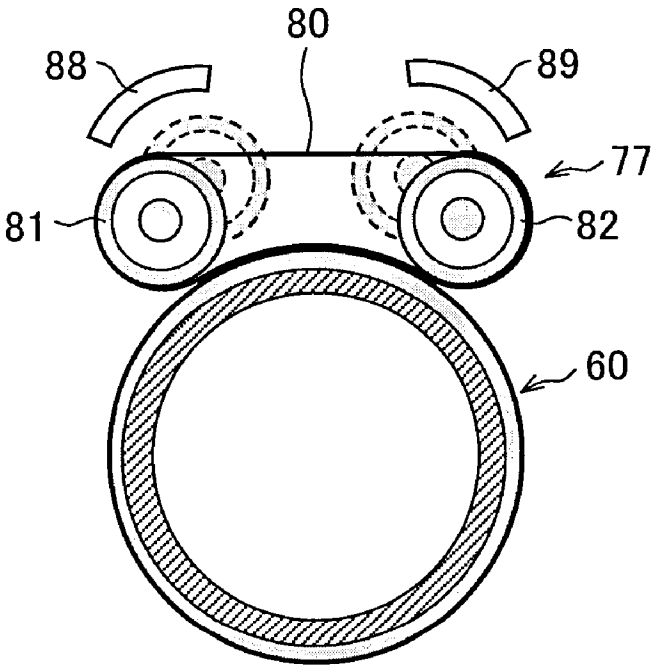
Figure 10:
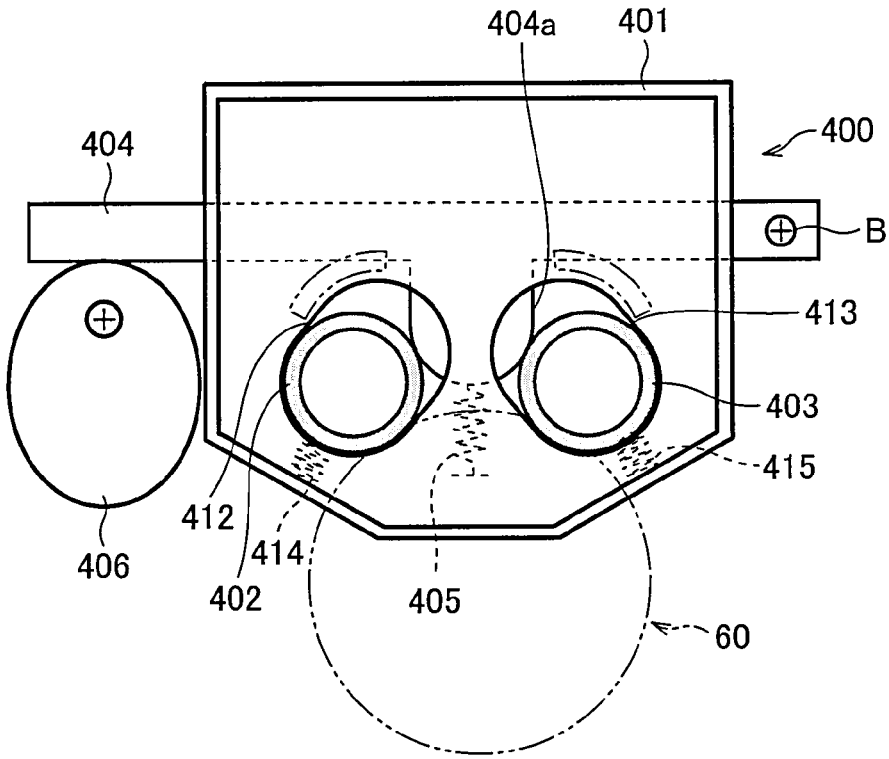
FIGS. 10(*a*) and 10(*b*) are diagrams illustrating a structure of a support section of an external heating section in the fixing apparatus shown in FIG. 9.
Figure 10:
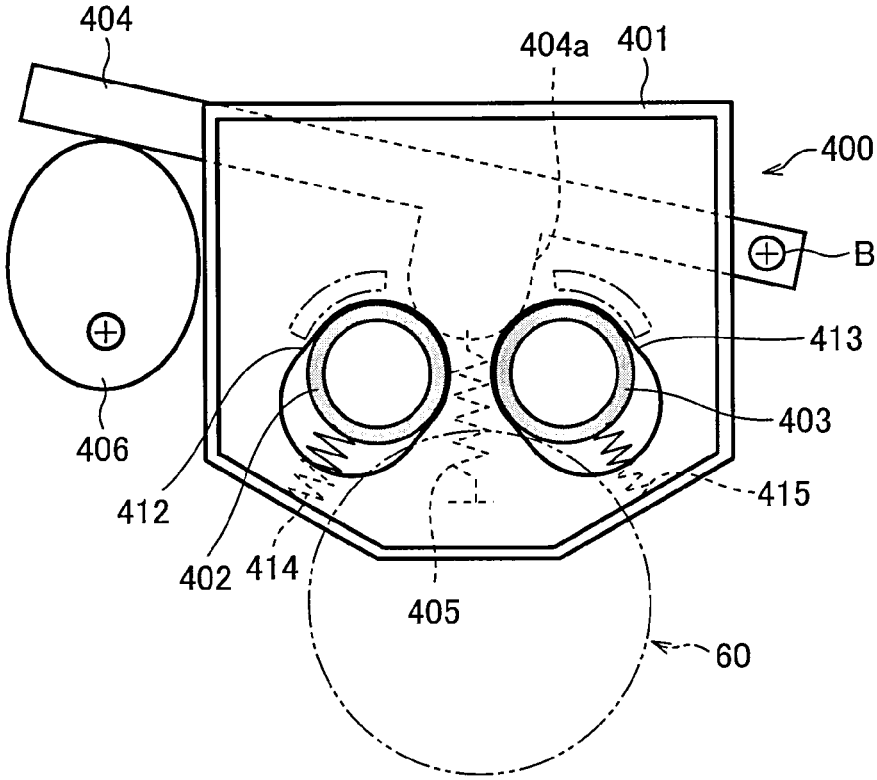

The following will describe another embodiment of the present invention with reference to FIGS. 9 and 10. Note that, for convenience of explanation, constituting members having the same functions are those described in the foregoing First through Third Embodiments are given the same reference numerals and explanations thereof are omitted here.

An image forming apparatus of the present embodiment differs from the image forming apparatus 1 of the First Embodiment only in the arrangements of the external heating section and the release/contact mechanism in the fixing apparatus 40. As such, the following description only deals with the external heating section and the release/contact mechanism.

FIGS. 9(*a*) and 9(*b*) are diagrams representing positions of the external heating belt 80 and the heat rollers 81 and 82 in an external heating section 77. FIGS. 10(*a*) and 10(*b*) are diagrams illustrating a structure of a support section for the external heating section 77. The release/contact mechanism 400 is provided in the support section.

The heat rollers 81 and 82 suspending the external heating belt 80 are rotably supported on bearings 402 and 403, respectively, that are mounted on a side frame 401. In the release/contact mechanism 400, the side frame 401 is mounted on an anchor such as a main frame (not shown).

The side frame 401 has two downwardly diverging guide holes 412 and 413 for respectively guiding the bearings 402 and 403, so that the bearings 402 and 403 can move along the guide holes 412 and 413, respectively.

To the bearings 402 and 403 are attached ends of bearing springs 414 and 415, respectively, whose other ends are attached to the side frame 401. By the elasticity of the bearing springs 414 and 415, the bearings 402 and 403 are spring loaded diagonally upward toward each other.

An arm 404 is rotably supported on the fulcrum B, and an eccentric cam 406, provided on the side of the arm 404 where the fixing roller 60 is installed, is in contact with the arm 404 at the opposite end with respect to the fulcrum B. The arm 404 includes a protrusion 404*a*, which is attached to a coil spring 405 by which the arm 404 is spring loaded toward the fixing roller 60.

As shown in FIG. 10(*a*), the protrusion 404*a* of the arm 404, under the load of the coil spring 405, enters the space between the bearings 402 and 403 and pushes the bearings 402 and 403 downward. As a result, the bearings 402 and 403 are brought into contact with the lower edges of the guide holes 412 and 413, respectively. Under this condition, the heat rollers 81 and 82 are pressed against the fixing roller 60 under the same load, as shown in FIG. 9(*a*).

When the eccentric cam 406 is rotated 180° in the state shown in FIG. 10(*a*) in which the heat rollers 81 and 82 are pressed against the fixing roller 60, the eccentric cam 406 pushes the arm 404 at the opposite end with respect to the fulcrum B and this end of the arm 404 is lifted up, as shown in FIG. 10(*b*). This causes the coil spring 405 to stretch, and the protrusion 404*a* of the arm 404 moves upward. By the restoring force of the bearing springs 414 and 415, the bearings 402 and 403 move diagonally upward toward each other until in contact with the upper edges of the guide holes 412 and 413, respectively. Under this condition, the heat rollers 81 and 82 are separated from the fixing roller 60 and the external heating belt 80, as shown in FIG. 9(*b*).

Further, in the external heating section 77 of the present embodiment, there are provided belt guides 88 and 89 for regulating the shape of the external heating belt 80. The belt guides 88 and 89 are provided above the heat rollers 81 and 82 assuming the short center distance position. The belt guides 88 and 89 are provided to prevent the external heating belt 80 from restoring its original cylindrical shape, which occurs when the heat rollers 81 and 82 assume the short center distance position. By the provision of the belt guides 88 and 89, the heat rollers 81 and 82 are brought into contact with the belt guides 88 and 89, and the flexure as shown in FIG. 9(*b*) is maintained. This prevents the external heating belt 80 from coming into contact with the heat rollers 81 and 82.

According to the foregoing arrangements of the external heating section 77 and the release/contact mechanism 400, the heat rollers 81 and 82 are separated from the external heating belt 80 and the fixing roller 60. This prevents the transfer of heat from the heat rollers 81 and 82 to the fixing roller 60. At the same time, the external heating belt 80 can be prevented from being overheated by the heat of the heat rollers 81 and 82. Further, the foregoing arrangements reduce the tension in the external heating belt 80 to such a degree that the belt member hardly undergo deformation even when it is allowed to cool, thereby reliably preventing the problems caused by such deformation of the external heating belt 80.

Fifth Embodiment

Figure 11:
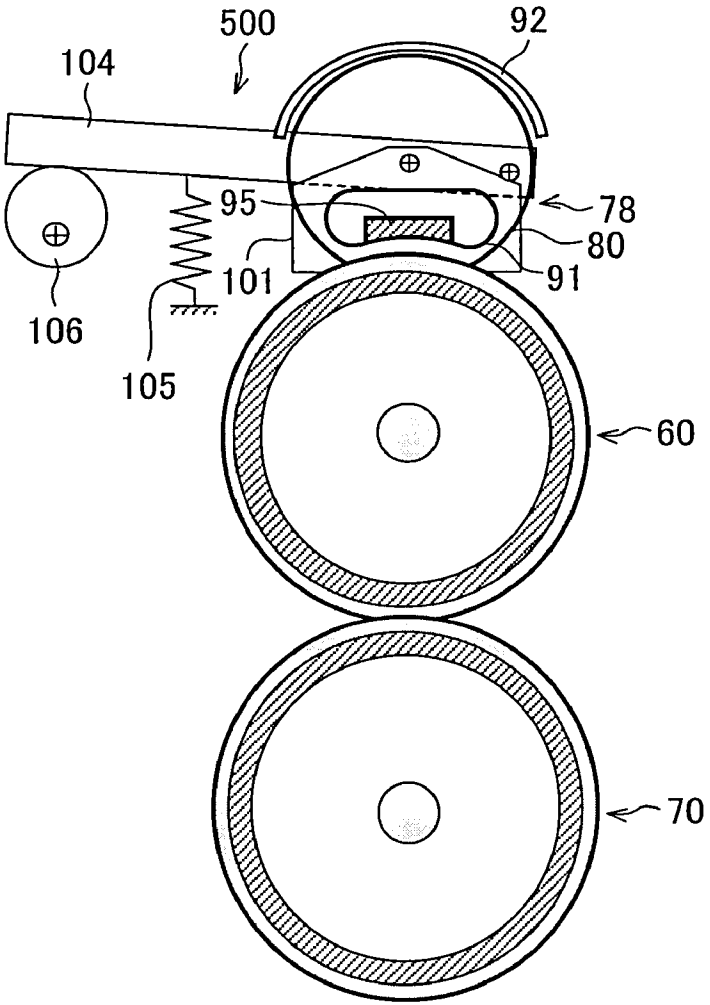
FIGS. 11(*a*) and 11(*b*) are diagrams illustrating a structure of an external heating section and a support section therefor, in a fixing apparatus according to yet another embodiment of the present invention.
Figure 11:
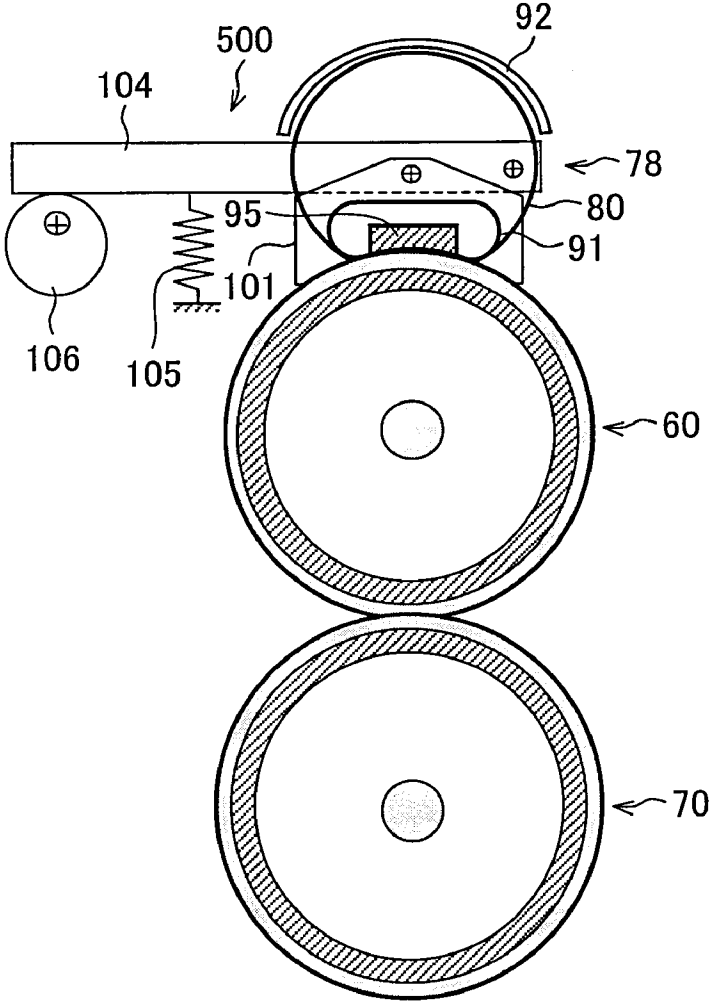

The following will describe another embodiment of the present invention with reference to FIG. 11. Note that, constituting members having the same functions as those described in the foregoing First through Fourth Embodiments are given the same reference numerals and explanations thereof are omitted here.

An image forming apparatus of the present embodiment differs from the image forming apparatus 1 of the First Embodiment only in the arrangements of the external heating section and the release/contact mechanism in the fixing apparatus 40. As such, the following description only deals with the external heating section and the release/contact mechanism.

FIGS. 11(*a*) and 11(*b*) are diagrams showing a structure of an external heating section 78 and a support section therefor. A release/contact mechanism 500 is provided in the support section.

In the external heating section 78, there is provided a heat element 95 as a heat source inside the external heating belt 80. The heat element 95 is anchored on a belt guide 91. When the external heating belt 80 rotates by following the rotation of the fixing roller 60, the heat element 95 and the belt guide 91 slide against the external heating belt 80.

The belt guide 91 and the heat element 95 anchored thereon are attached to a side frame 101. The side frame 101 is rotably supported on the arm 104 at a fulcrum A. The arm 104 is rotably supported on a fulcrum B.

A coil spring 105 is provided on the arm 104 at the opposite end with respect to the fulcrum B. Under the load of the coil spring 105 attached to the end portion of the arm 104, the side frame 101 attached to the arm 104 is spring loaded toward the fixing roller 60. As a result, the belt guide 91 and the heat element 95 attached to the side frame 101 are pressed against the fixing roller 60, as shown in FIG. 11(*a*).

When the eccentric cam 106 is rotated 180° in the state shown in FIG. 11(*a*) in which the belt guide 91 and the heat element 95 are pressed against the fixing roller 60, the eccentric cam 106 pushes the arm 104 at the opposite end with respect to the fulcrum B. In response, the coil spring 105 stretches and the fulcrum A moves away from the fixing roller 60, with the result that the belt guide 91 and the heat element 95 are separated from the fixing roller 60, as shown in FIG. 11(*b*).

Above the external heating belt 80, there is provided a belt guide 92 that maintains the shape of the external heating belt 80 while the belt guide 91 and the heat element 95 are separated from the fixing roller 60. By maintaining the shape of the external heating belt 80, the heat element 95 and the external heating belt 80 can be prevented from coming into contact with each other.

As described above, in the external heating section 78 and the release/contact mechanism 500, the heat element 95 that directly comes into contact with the external heating belt 80 can be brought into contact with or separated from the fixing roller 60 by the rotation of the eccentric cam 106.

The heat element 95 is made from an alumina substrate, 1 mm thick, that has been patterned with a resistance material such as silver-palladium and coated with a 10 μm thick heat-resistant glass layer. For the belt guides 91 and 92, heat-resistant resin such as polyamideimide, polyimide, or polyphenylene sulfide is used. On a sliding surface against the external heating belt 80, a lubricant such as a heat-resistant grease may be applied. On the other side of the sliding surface, the heat element 95 may be provided with a temperature-detecting element such as a resistance temperature sensor like a Pt film.

As described above, according to one aspect of the present invention, there are provided a fixing apparatus and an image forming apparatus, including an external heating section that brings an endless belt member into contact with a surface of a rotatable fixing member and supplies heat from the belt member to the fixing member so as to externally heat the fixing member, the fixing apparatus causing a printing medium to pass between the fixing member and a pressure member pressed against the fixing member, so as to fix a toner image formed on the printing medium, the external heating member including: the belt member; a heating member provided inside the belt member and pressed against the fixing member via the belt member; and a release/contact mechanism for causing the heating member to separate from or contact with the fixing member, the belt member and the fixing member being in contact with each other, with the heating member separated from the fixing member by the release/contact mechanism.

According to this arrangement, the release/contact mechanism enables the heating member inside the belt member to separate from or contact with the fixing member. By separating the heating member from the fixing member with the release/contact mechanism at the end of a fixing operation for example, it is possible to prevent the problem known as overshoot that occurs when the heating member, having a higher temperature than the fixing member, is pressed against the surface of the fixing member at rest, and that causes localized heating on the surface of the fixing member.

There are cases where the fixing temperature needs to be reduced during a fixing operation. The surface temperature of the fixing member can be effectively lowered by separating the heating member from the fixing member with the release/contact mechanism, and thereby cutting off the heat supply from the heating member.

According to the foregoing arrangement, when the heating member is separated from the fixing member, the belt member and the fixing member are in contact with each other and the belt member follows the rotation of the fixing member.

As described above, the temperature of the heating member remains greater than the surface temperature of the fixing member even after the heating in the fixing process is finished. This raises the temperature of the belt member in a portion in contact with the heating member, and this causes deterioration in this portion of the belt member. In order to suppress such deterioration of the belt member, it is preferable to continue rotating the belt member even after the heating member has been separated from the fixing member. By the rotation, the heat from the heating member is transferred to all parts of the belt member, and deterioration of the belt member can be effectively suppressed. However, if a driving mechanism for rotating the belt member for this purpose is additionally provided, the size of the fixing apparatus would be increased.

According to an embodiment of the present invention, deterioration of the belt member can be effectively suppressed without additionally providing such a driving mechanism and increasing the size of the fixing apparatus.

The arrangement in which the belt member follows the rotation of the fixing member with the heating member separated from the fixing member can be attained, for example, by so setting the distance by which the heating member is separated from the fixing member as to allow the belt member to follow the rotation of the fixing member, or by providing a pressing member by which the belt member is pressed against the fixing member.

Because the belt member and the fixing member are in contact with each other with the heating member separated from the fixing member, the heating member needs to travel over a shorter distance as compared with the arrangement in which the belt member is completely separated. As a result, a smaller space is required for the release/contact, and quick release/contact can be made in a small space and at low power.

Further, a fixing apparatus and an image forming apparatus of the present invention may be adapted so that the belt member is suspended by a plurality of heatable belt-suspending rollers having heat sources therein, the belt-suspending rollers each serving as the heating member, and that the release/contact mechanism moves a support frame that supports bearings respectively provided for the belt-suspending rollers, so as to cause the heating member to separate from or contact with the fixing member.

According to this arrangement, the support frame is moved that supports the respective bearings of the belt-suspending rollers. By thus moving the belt member with the heating member, the release or contact can be made with a simple structure. A quick release/contact operation is also possible.

A fixing apparatus of the present invention may be adapted so that the belt member is suspended by a plurality of belt-suspending rollers including at least one heatable belt-suspending roller having a heat source therein, and at least one unheated belt-suspending roller, the heatable belt-suspending roller serving as the heating member, and that the release/contact mechanism moves the heatable belt-suspending roller and does not move the unheated belt-suspending roller.

A fixing apparatus and an image forming apparatus of the present invention may be adapted so that the belt member is suspended by at least one heatable belt-suspending roller having a heat source therein, and by an unheated belt-suspending roller, the heatable belt-suspending roller serving as the heating member, and that the heatable belt-suspending roller and the unheated belt-suspending roller respectively having bearings that are supported on a single support frame, and that the release/contact mechanism moves the heatable belt-suspending roller by rotating the support frame about a rotational axis of the unheated belt-suspending roller.

According to the foregoing arrangements, only the heated belt-suspending roller is moved and the unheated belt-suspending roller is not moved. Thus, a shorter distance is required for the release/contact, as compared with moving all belt-suspending rollers. This reduces the size of the fixing apparatus and power consumption of the release/contact mechanism. Further, since the unheated belt-suspending roller is in contact with the surface of the fixing member via the belt member, it is ensured that the belt member follows the rotation of the fixing member. As a result, deterioration of the belt member can be suppressed more effectively.

A fixing apparatus and an image forming apparatus of the present invention may be adapted so that the belt member is suspended by a plurality of belt-suspending rollers including a heatable belt-suspending roller having a heat source therein, the heatable belt-suspending roller serving as the heating member, and that the release/contact mechanism separates the heatable belt-suspending roller from the belt member.

According to this arrangement, the heatable belt-suspending roller serving as the heating member is also separated from the belt member. As a result, deterioration of the belt member can be suppressed more effectively.

The arrangement in which the heatable belt-suspending roller is separated from the belt member can be realized, for example, with an arrangement in which the belt member is suspended by a pair of belt-suspending rollers at least one of which has a heat source therein, the heatable belt-suspending roller having the heat source therein serving as the heating member, and in which the release/contact mechanism moves the pair of belt-suspending rollers such that the belt-suspending rollers separate away from the surface of the fixing member, and that a center distance between the belt-suspending rollers becomes shorter, the fixing apparatus including a belt guide member that retains a shape of the belt member by restraining changes in shape of the belt member that occurs when the movement of the pair of belt-suspending rollers loosens a tension in the belt member.

A fixing apparatus and an image forming apparatus of the present invention may be adapted so that the heating member is a heat source that directly heats the belt member, and that the release/contact mechanism separates the heat source from the belt member.

According to this arrangement, the heating member serving as the heat source is separated from the belt member. As a result, deterioration of the belt member can be suppressed more effectively.

The arrangement in which the heat source is separated from the belt member can be realized, for example, with an arrangement in which the heating member is a heat source that directly heats the belt member, and in which the release/contact mechanism moves a support frame supporting the heat source, so as to cause the heating member to separate from or contact with the fixing member, the fixing apparatus including a belt guide member that retains a shape of the belt member by restraining changes in shape of the belt member that occurs when the heat source releases the pressure of the belt member pressed against the fixing member.

An fixing apparatus and an image forming apparatus of the present invention may be adapted to include a control section for controlling driving of the release/contact mechanism, wherein the control section causes the heating member to separate from the fixing member while rotation of the fixing member is stopped.

The belt member in the external heating section is prone to deformation when it is allowed to cool to room temperature from the heated state while it is still in contact with the fixing member and has a sufficient tension. If the belt member that has undergone deformation were rotated for heating, the rotation of the belt member would be unstable. In the worst case, the belt member stops and its ability to heat the fixing member suffers greatly, and other problems may be caused such as damage to the belt member.

According to the foregoing arrangement, the control section causes the release/contact mechanism to separate the heating member from the fixing member while the fixing member is not rotating. This reduces the tension in the belt member as compared with the arrangement in which the heating member continues to apply pressure. As a result, the belt member does not easily deform even when it is allowed to cool, and the problems caused by deformation can be avoided.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus that comprises a fixing apparatus including an external heating section that brings an endless belt member into contact with a surface of a rotatable fixing member and supplies heat from the belt member to the fixing member so as to externally heat the fixing member, said fixing apparatus causing a printing medium to pass between the fixing member and a pressure member pressed against the fixing member, so as to fix a toner image formed on the printing medium, the external heating section including; the belt member; a heating member provided inside the belt member and pressed against the fixing member via the belt member; and a release/contact mechanism for causing the heating member to separate from or contact with the fixing member, the belt member and the fixing member being in contact with each other, with the heating member separated from the fixing member by the release/contact mechanism, wherein the belt member is provided with a resin layer;

wherein the belt member is suspended by a plurality of belt-suspending rollers including at least one heatable belt-suspending roller having a heat source therein, and at least one unheated belt-suspending roller, the heatable belt-suspending roller serving as the heating member, and wherein the release/contact mechanism moves the heatable belt-suspending roller and does not move the unheated belt-suspending roller.

2. The apparatus as set forth in claim 1, wherein the belt member is suspended by at least one heatable belt-suspending roller having a heat source therein, and by an unheated belt-suspending roller, the heatable belt-suspending roller serving as the heating member, wherein the heatable belt-suspending roller and the unheated belt-suspending roller respectively having bearings that are supported on a single support frame, and wherein the release/contact mechanism moves the heatable belt-suspending roller by rotating the support frame about a rotational axis of the unheated belt-suspending roller.

3. The image forming apparatus of claim 1 wherein the belt member comprises a belt base material having a surface and the resin layer comprises a releasing layer on the surface of the belt base material.

4. An image form apparatus that comprises a fixing apparatus including an external heating section that brings an endless belt member into contact with a surface of a rotatable fixing member and supplies heat from the belt member to the fixing member so as to externally heat the fixing member, said fixing apparatus causing a printing medium to pass between the fixing member and a pressure member pressed against the fixing member, so as to fix a toner image formed on the printing medium, the external heating section including: the belt member; a heating member provided inside the belt member and pressed against the fixing member via the belt member; and a release/contact mechanism for causing the heating member to separate from or contact with the fixing member, the belt member and the fixing member being in contact with each other, with the heating member separated from the fixing member by the release/contact mechanism, wherein the belt member is provided with a resin layer;

wherein the belt member is suspended by a pair of belt-suspending rollers at least one of which has a heat source therein, the heatable belt-suspending roller having the heat source therein serving as the heating member, and wherein the release/contact mechanism moves the pair of belt-suspending rollers such that the belt-suspending rollers separate away from the surface of the fixing member, and that a center distance between the belt-suspending rollers becomes shorter, said fixing apparatus comprising a belt guide member that retains a shape of the belt member by restraining changes in shape of the belt member that occurs when the movement of the pair of belt-suspending rollers loosens a tension in the belt member.

5. The image forming apparatus of claim 4 wherein the belt member comprises a belt base material having a surface and the resin layer comprises a releasing layer on the surface of the belt base material.

6. An image forming apparatus that comprises a fixing apparatus including an external heating section that brings an endless belt member into contact with a surface of a rotatable fixing member and supplies heat from the belt member to the fixing member so as to externally heat the fixing member, said fixing apparatus causing a printing to pass between the fixing member and a pressure member pressed against the fixing member, so as to fix a toner image formed on the printing medium, the external heating section including: the belt member; a heating member provided inside the belt member and pressed against the fixing member via the belt member; and a release/contact mechanism for causing the heating member to separate from or contact with the fixing member, the belt member and the fixing member being contact with each other, with the heating member separated from the fixing member by the release/contact mechanism, wherein the belt member is provided with a resin layer;

wherein the heating member is a heat source that directly heats the belt member, and wherein the release/contact mechanism moves a support frame supporting the heat source, so as to cause the heating member to separate from or contact with the fixing member, said fixing apparatus comprising a belt guide member that retains a shape of the belt member by restraining changes in shape of the belt member that occurs when the heat source releases the pressure of the belt member pressed against the fixing member.

7. The image forming apparatus of claim 6 wherein the belt member comprises a belt base material having a surface and the resin layer comprises a releasing layer on the surface of the belt base material.

* * * * *